US009163435B2

(12) United States Patent
Zysk et al.

(10) Patent No.: US 9,163,435 B2
(45) Date of Patent: Oct. 20, 2015

(54) CLOSURE SYSTEM FOR EMERGENCY RELEASE OF A TRUNK COMPARTMENT, ESPECIALLY A FRONT TRUNK COMPARTMENT

(75) Inventors: Florian Zysk, Berlin (DE); Joachim Schuetz, Hillerse (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 529 days.

(21) Appl. No.: 13/336,521

(22) Filed: Dec. 23, 2011

(65) Prior Publication Data

US 2012/0161453 A1 Jun. 28, 2012

(30) Foreign Application Priority Data

Dec. 23, 2010 (DE) ..... 10 2010 056 413

(51) Int. Cl.
*E05B 65/10* (2006.01)
*E05B 83/24* (2014.01)
*E05B 83/26* (2014.01)

(52) U.S. Cl.
CPC ..... *E05B 83/24* (2013.01); *E05B 83/26* (2013.01); *Y10T 292/0822* (2015.04)

(58) Field of Classification Search
USPC ..... 292/21, 92, DIG. 65, DIG. 14
See application file for complete search history.

(56) References Cited

U.S. PATENT DOCUMENTS

| | | | | |
|---|---|---|---|---|
| 5,853,060 | A | 12/1998 | Chao et al. | |
| 6,422,616 | B1 * | 7/2002 | Wortmann et al. | 292/216 |
| 2007/0216170 | A1 * | 9/2007 | Drescher et al. | 292/201 |

FOREIGN PATENT DOCUMENTS

| | | | |
|---|---|---|---|
| DE | 10 2004 011 798 | B3 | 10/2005 |
| DE | 10 2005 021 740 | A1 | 11/2006 |
| DE | 10 2006 012 062 | A1 | 9/2007 |
| DE | 10 2007 029 679 | A1 | 1/2009 |
| DE | 10 2008 005 273 | A1 | 7/2009 |
| EP | 100855 | A1 * | 2/1984 |
| WO | WO 01/00954 | A1 | 1/2001 |

* cited by examiner

*Primary Examiner* — Mark Williams
(74) *Attorney, Agent, or Firm* — Muncy, Geissler, Olds & Lowe, P.C.

(57) ABSTRACT

A closure system for emergency release of a motor vehicle cavity that is closed with a lid of a trunk compartment, which comprises, in a lock on the trunk side, a rotary latch arranged such that it can pivot about a second axis of rotation, which latch is held securely in a closed position of the lid via a detent pawl arranged such that it can pivot about a first axis of rotation, and a catch hook associated with the rotary latch, wherein a striker is located on the lid side that stands in operative connection with the rotary latch in the closed position, in that the rotary latch locks the striker with respect to a lock housing, wherein the lid is temporarily captured and held in an intermediate position by the catch hook, via the striker, after deactivation of the locking of the rotary latch.

19 Claims, 5 Drawing Sheets

CLOSURE SYSTEM FOR EMERGENCY RELEASE OF A TRUNK COMPARTMENT, ESPECIALLY A FRONT TRUNK COMPARTMENT

This nonprovisional application claims priority under 35 U.S.C. §119(a) to German Patent Application No. DE 10 2010 056 413.3, which was filed in Germany on Dec. 23, 2010, and which is herein incorporated by reference.

The invention concerns a closure system for emergency release of a trunk compartment, especially a front trunk compartment.

Such closure systems or so-called latching systems must reliably meet ever more demanding requirements with regard to safety aspects and safety regulations. Legal provisions, such as the "Internal Trunk Release FMVSS 401" provisions for motor vehicles that took effect Sep. 1, 2001 in the United States, an especially high-volume market for vehicles, require a trunk compartment emergency release system by means of which a person trapped in the trunk can escape by actuating an emergency actuation element.

According to the definition underlying this regulation, a trunk compartment is a space that is intended to be used for carrying luggage or cargo, is wholly separated from the driver's or passenger compartment by a partition or by fixed or fold-down seats, can be closed to the outside by a trunk lid or hood, and has an interior of a size that can hold a three-year-old child test dummy with the trunk lid closed and latched.

In the case of vehicles in which the trunk compartment is located in the front, and hence under a front hood, for design reasons, for example because the engine is located in the rear of the vehicle, the aforementioned regulation requires the following provisions to be met:

When the vehicle is traveling forward at a speed of 5 km/h or above, a secondary safety mechanism, such as a catch element, must prevent the trunk lid from opening further if the trunk lock has been unintentionally or wrongfully released.

When the vehicle is traveling forward at a speed of less than 5 km/h, the trunk lid must release when the emergency release mechanism is actuated. In addition, it is permissible at these speeds for the emergency release mechanism to release the catch mechanism to permit the trunk lid to open further.

When the vehicle is stationary, unimpeded opening of the trunk lid must be ensured when the emergency release mechanism is actuated.

The following closure mechanisms with such an emergency unlatching function are known at present:

DE 10 2005 021 740 A1 discloses a latching system for a motor vehicle trunk that can be unlocked in an emergency, having a trunk lock that comprises at least one lock latch and one cooperating latching part, having a catch mechanism that limits the trunk opening motion and comprises a catch hook for deactivating the limitation of motion, which can be actuated from outside the trunk, and a cooperating catch hook engagement element, and having an emergency release mechanism located in the trunk that when actuated has the effect of unlocking the trunk lock and releasing the catch mechanism. In order to have a simple structure while at the same time providing a higher safety standard and fulfilling safety provisions with respect to the speed-dependent permissibility of emergency unlatching, the actions of the emergency release mechanism on the trunk lock and on the catch mechanism are decoupled from one another.

Also known, from DE 10 2006 012 062 A1, is a closure mechanism, in particular for a trunk lid of a motor vehicle, having a rotary latch that works together with a lid-mounted striker. The rotary latch is held securely in a closed position by means of a detent pawl. The closure mechanism comprises a lid-mounted catch hook that can be brought into engagement with a catch element once the detent pawl has been moved into an open position, which catch hook is used for keeping the lid in a holding position, wherein the catch hook can be moved from the holding position into an open position in which the lid can be fully opened, wherein the rotary latch and the catch hook are implemented as separate parts. In this design, the detent pawl of the rotary latch and the catch hook are to be actuated one after the other in sequence by a common remote actuating mechanism, but it is necessary to transmit the actuation to the catch hook through an additional catch hook lever, since the catch hook is not located on the lock, but rather on the lid. This solution cannot be adopted for a closure mechanism with a combination of detent pawl, rotary latch, and catch hook located together in the lock.

The starting point for the present invention is the applicant's DE 10 2008 005 273 A1. This document describes a closure system for a front lid that has essentially a rotary latch arranged such that it can pivot about an axis of rotation, a catch hook associated with said latch, a striker, and a detent pawl that likewise is arranged such that it can pivot about an axis of rotation, wherein, when the front lid is in the closed position, the rotary latch stands in operative connection with the striker located on the front lid in that the rotary latch receives the center bar of the essentially U-shaped striker inside a forked recess matched to the shape of the striker, and when the latching of the front lid is deactivated, the striker stands in operative connection with a catch hook that performs a securing function when locking by the rotary latch is deactivated, wherein separate stops are associated with the rotary latch and the detent pawl, and the detent pawl can be actuated by a Bowden cable or by a first electric motor drive.

The prior art closure system is shown in FIG. 1. The front lid system essentially comprises a detent pawl 2 arranged such that it can pivot about a first axis of rotation 1, a rotary latch 4 arranged such that it can pivot about a second axis of rotation 3, a catch hook 5 that can pivot about a third axis of rotation 3A, and a striker 6, wherein the catch hook 5 is associated with the rotary latch 4. The detent pawl 2 and the rotary latch 4 are mounted in a lock cover of a motor vehicle. The striker 6 is located on the front lid of the motor vehicle in such a manner that, when the front lid is in the closed position, the rotary latch 4 stands in operative connection with the striker 6 and is locked by the detent pawl 2. The striker 6 is essentially U-shaped and has a center bar 10. The rotary latch 4 is forked in design and has a recess 8 that is matched to the contour of the center bar 10. In the locked state, the recess 8 receives the center bar 10 of the striker 6. The rotary latch 4 also has a stop 7 that engages a formation 9 in the form of a tooth segment on the detent pawl 2 in the locked state. In this locked position, the rotary latch 4 securely receives the center bar 10 of the striker 6 in its recess 8. This state is not shown in FIG. 1. The catch hook 5 is connected to a return spring 16. In addition, the catch hook 5 has, at one free end 12, a hook part 13, which performs a securing function. When latching of the front lid is deactivated, the hook part 13 receives the center bar 10 of the striker 6. The catch hook 5 is preloaded in the locking position by the return spring 16, so that when the locking is released the center bar 10 is initially prevented by the hook part 13 from opening fully in its opening travel upward. A limit stop 24 is located on the lock to the back of the catch hook 5. The limit stop 24 only allows the catch hook 5 to pivot up to a certain angle. The catch hook 5 pivots up to the stop 24 as a result of the force $F_R$ of the return spring 16, and is assisted by the ejector spring 14, which presses on the striker 6 and acts on the catch hook 5 through the striker 6.

The detent pawl 2 can be actuated manually by a Bowden cable that is not shown or by an electric motor. Actuation of the Bowden cable or of the electric motor drive triggers the release of the locked state. As a result of the triggering, the formation 9 of the detent pawl 2 is pulled away from the stop 7 of the rotary latch 4, causing the rotary latch 4, which is preloaded by a spring 15, to rotate about the second axis of rotation 3 and causing the catch hook 5, which likewise is preloaded by the spring 16, to pivot about the third axis of rotation 3A and carry the center bar 10 of the striker 6 along in its hook part 13 and hold it in an intermediate position that depends on the spring force of the return spring 16. The ejector spring 14 acts on the striker 6 to be opened and presses it upward upon actuation of the Bowden cable, which is operated by means of a handle, or upon actuation of the electric motor drive. In the exemplary embodiment, the third axis of rotation 3A of the catch hook 5 runs on a common axis of rotation with the second axis of rotation 3 of the rotary latch 4, wherein the catch hook 5 can pivot about the third axis of rotation 3A associated therewith independently of the rotary latch 4. In the example shown, the second axis of rotation 3 of the rotary latch 4 and the third axis of rotation 3A of the catch hook 5 thus coincide. The front lid can be opened from the outside by laterally pivoting the striker 6 out of the catch hook 5. During the necessary actuation, the center bar 10 of the striker 6A assumes the position shown in FIG. 1.

The front lid system described does not permit complete emergency release of the front lid without a separate actuation action from the outside, so the emergency requirement of the abovementioned provision of "Internal Trunk Release FMVSS 401" is not fulfilled, since it does not permit a simultaneous release of the catch hook and rotary latch, or of the combination of detent pawl and rotary latch, to open the front lid from within the trunk. In the prior art, the front lid cannot be opened fully until the striker 6—oriented vertically in FIG. 1—has been pivoted out of the hook 13 of the catch hook 5 into the position. To this end, the striker has a striker handle 10A, which is not shown in FIG. 1. This striker handle 10A is shown in conjunction with the invention. This actuation of the striker handle 10A can only be undertaken from outside, however, so that a person inside the trunk, for example a small child, cannot undertake such a release from inside the trunk in an emergency situation. The closure system according to the invention, which is also called a child emergency release, remedies this disadvantage and ensures that an actuation of the emergency release mechanism when the vehicle is traveling forward at a speed of less than 5 km/h releases the trunk lid completely with a single operator action.

The object of the invention is to specify a latching system with emergency release, hereinafter also referred to as a closure system, for a motor vehicle trunk, which has a simple structure while at the same time providing a higher safety standard and, in particular, fulfilling the regulations described further above.

Based on the prior art, the known closure system from DE 10 2008 005 273 A1 is modified with regard to the provisions to be met.

The new closure system for emergency release of a motor vehicle cavity that is closed with a lid, in particular for complete release of a front lid of a trunk compartment of the vehicle, comprises, in a lock of the closure system on the trunk side, a rotary latch arranged such that it can pivot about a second axis of rotation, which latch is held securely in a closed position of the lid by means of a detent pawl arranged such that it can pivot about a first axis of rotation, and a catch hook associated with the rotary latch. Located on the lid side is a striker, which stands in operative connection with the rotary latch in the closed position, in that the rotary latch locks the striker with respect to a lock housing, wherein the lid is temporarily captured and held in an intermediate position by the catch hook, by means of the striker, after deactivation of the locking of the rotary latch.

Provision is made according to the invention for the unlocking of the rotary latch and the release of the catch hook that has been captured in the intermediate position to be accomplished, for complete release of the lid in an emergency, by means of a first handle standing in operative connection with the rotary latch and the catch hook by means of a first remote actuating mechanism, said handle being located in the cavity that is closed by the lid.

In a preferred embodiment of the invention, the closure system has a first Bowden cable as the first remote actuating mechanism. This first Bowden cable of the first remote actuating mechanism serves the purpose of emergency release of the lid and accomplishes a complete release of the striker of the lid.

Independently thereof, the closure system can have a second remote actuating mechanism, which likewise is implemented as a second Bowden cable. This second Bowden cable of the second remote actuating mechanism accomplishes a partial release of the striker up to an intermediate position of the lid. This second Bowden cable corresponds to the Bowden cable described in the prior art, or the electric motor drive described there. Only the functions that were explained in the description of the prior art can be achieved with this second Bowden cable or the second electric motor drive.

If both remote actuating mechanisms are implemented, then the first and the second Bowden cables each act on the detent pawl of the rotary latch of the closure system in separate locations so that the striker of the lid can be released in a first stage of the actuation with respect to the housing of the lock.

After actuation of the second Bowden cable, the striker remains beneath the catch hook until a striker handle pivots the striker into a pivoted position so that the laterally pivoted striker comes free of the catch hook, with the result that the lid can be opened completely.

However, since this actuation can only be undertaken from the outside, provision is made in a preferred embodiment of the invention that, by means of further actuation of the first Bowden cable in a second stage of the actuation, the catch hook is pivoted in advantageous manner, with the result that the striker comes free of the catch hook without pivoting laterally, so that the lid can be opened completely.

In a preferred embodiment of the invention, a Bowden cable wire of the first Bowden cable is secured in a first wire receptacle of the detent pawl, by which means the detent pawl, in the first step of the actuation for emergency release by pulling on the first handle, pivots about the second axis of rotation and releases the rotary latch, which assumes a position that releases the striker, but the striker is initially captured in the intermediate position by the catch hook, as in the actuation by means of the second Bowden cable according to the prior art.

In another preferred embodiment of the invention, provision is made that a Bowden cable jacket is supported up to the first Bowden cable in a first Bowden cable receptacle, by which means pulling on the first handle in a second step of the actuation for emergency release causes the catch hook to pivot about a third axis of rotation and release the catch hook, which moves from the intermediate position to assume a position that completely releases the striker and hence the lid.

In another preferred embodiment of the invention, provision is made for the catch hook to have, on an end opposite the hook part, a detent projection that engages a contour of a detent element corresponding to the detent projection when the catch hook is in the position that releases the striker, wherein the pivoting of the catch hook into the striker-releasing position causes the detent element to be pivoted about a fourth axis of rotation into a position that temporarily latches the catch hook securely.

Consequently, a second actuation possibility for the emergency release is created in an advantageous manner with little material used and little need for changes to the detent pawl and catch hook, as well as by arrangement of the detent element that previously was not present with respect to the arrangement of the first Bowden cable and with respect to the securely latching position of the catch hook within the closure system.

The invention provides for the closure system to have a first remote actuating mechanism and a second remote actuating mechanism. In advantageous fashion, it is proposed for the first remote actuating mechanism for emergency release of the lid of the closure system to be located in a forward trunk compartment of the vehicle, wherein the second remote actuating mechanism for releasing the lid of the closure system in the intermediate position is located in the passenger compartment of the vehicle.

In an advantageous manner, therefore, an emergency release can be accomplished through a first handle of the first remote actuating mechanism from within the forward trunk compartment and through a second handle of the second remote actuating mechanism from the passenger compartment of the vehicle.

As a result of the fact that two remote actuating mechanisms are now present, the invention makes provision for providing both of the remote actuating mechanisms with a blocking mechanism.

In a preferred embodiment of the invention, provision is made that the actuation of the catch hook can be suppressed during emergency release of the lid of the closure system and/or during release of the lid of the closure system in the intermediate position, by means of an arranged first blocking mechanism and/or an arranged second blocking mechanism. The suppression, which is to say the blocking or release of the detent pawl (second blocking mechanism) and/or of the catch hook (first blocking mechanism), takes place as a function of a predefinable driving speed of the vehicle or as a function of a switching command originating from the central locking system.

In a preferred embodiment of the invention, the second blocking mechanism of the detent pawl can be implemented as follows: The second blocking mechanism includes, for example, an electromagnet that is powered or not powered as a function the driving speed of the vehicle. If the second handle is actuated from within the passenger compartment, then the detent pawl is pulled by an appropriate movement of a Bowden cable wire of the second Bowden cable relative to the Bowden cable jacket of the second Bowden cable, by which means the detent pawl releases the rotary latch. If the movement of the Bowden cable wire is to be prevented, the electromagnet of the second blocking mechanism is powered, so that a movement of the Bowden cable wire is avoided. This measure ensures that the striker of the lid, and thus the lid, remains completely closed as long as the travel speed is not below 5 km/h and/or an appropriate signal is present from the central locking system regarding opening the lid in the intermediate position.

In another preferred embodiment of the invention, the first blocking mechanism of the catch hook can be implemented as follows: The first blocking mechanism has an actuating unit, which comprises a mechanical coupling member. This mechanical coupling member acts to block or release the Bowden cable receptacle of the Bowden cable jacket of the first Bowden cable of the catch hook. This measure ensures that the striker of the lid, and hence the lid, does reach the intermediate position, but the catch hook remains in a blocking position as long as the travel speed is not below 5 km/h and/or an appropriate signal is present from the central locking system regarding complete opening of the lid.

Additional changes that are necessary in the modification of the known closure system in order to ensure the functions of the new closure system are explained in the detailed description below.

Additional preferred embodiments of the invention are evident from the additional features identified in the dependent claims.

The invention is explained below using an exemplary embodiment with reference to the associated drawings. In particular, the differences from the closest prior art are explained, especially the differences from the closure system described in the document DE 10 2008 005 273 A1.

FIG. 5 shows a perspective representation of the closure system, the remotely actuatable emergency release, and an actuating unit in a view of the trunk compartment from the outside looking in.

Figure 1:
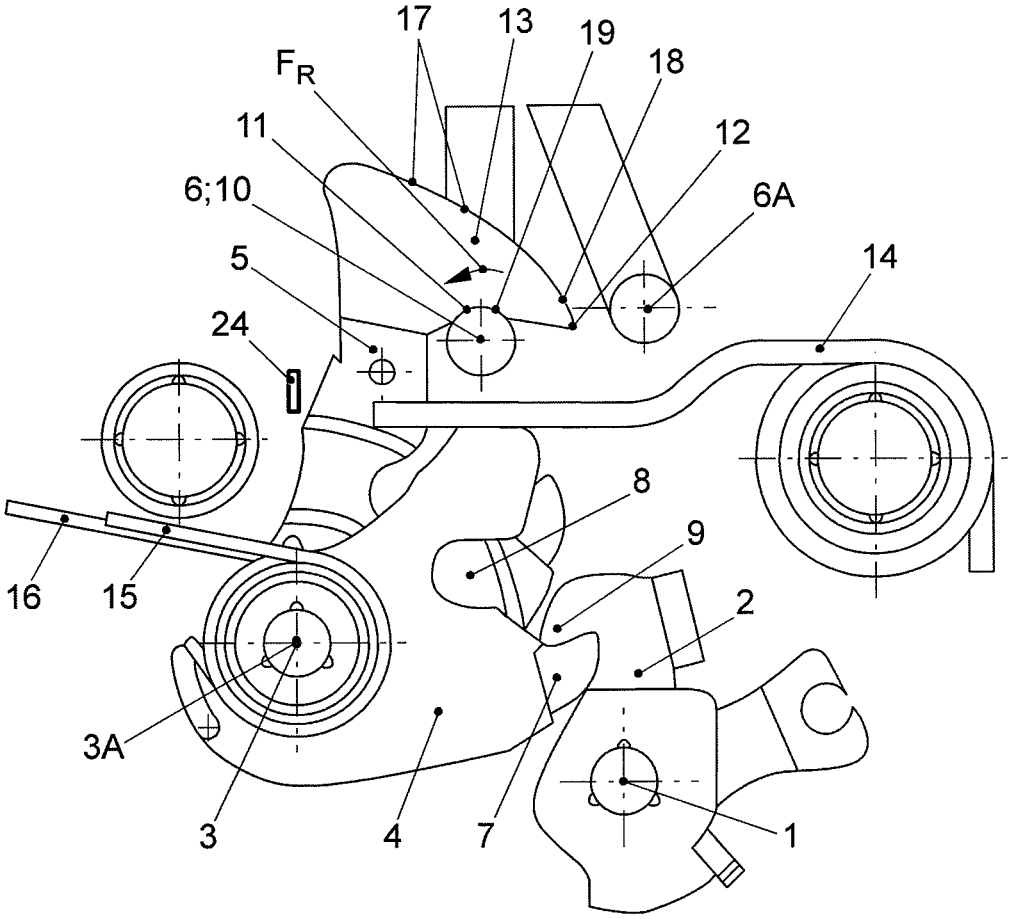
FIG. 1 shows a schematic representation of a closure system, in particular a front lid system according to the prior art.
Figure 2:
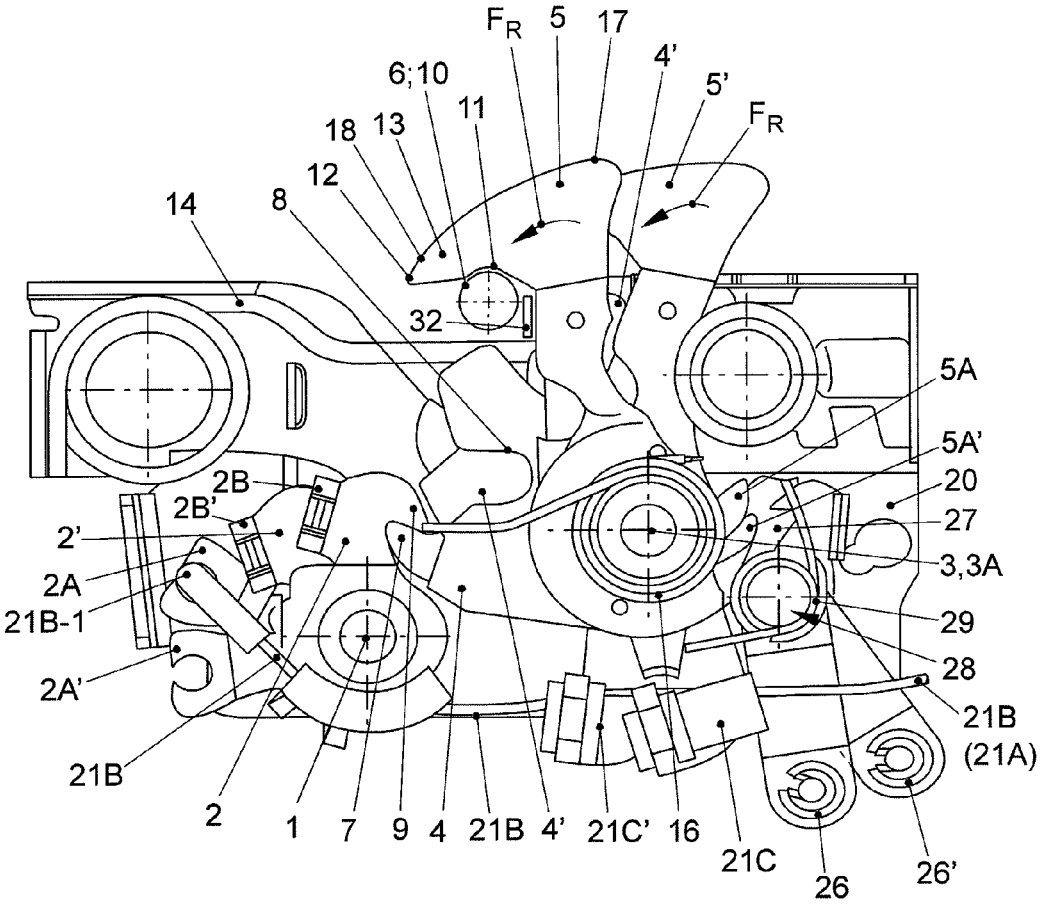
FIG. 2 shows a schematic representation of a closure system according to the invention, in particular a front lid system, in a view from the inside of a trunk compartment looking out.

Using the known closure system in FIG. 1 as a starting point, FIG. 2 shows the new closure system, wherein the reference characters from FIG. 1 are used again for components already described in the introduction. The way a release of a front lid was previously accomplished has thus already been described.

Reference is made to the fact that the previous solution and the new solution have been developed especially for motor vehicles in which the trunk compartment is located in the front of the vehicle. However, the two solutions are not limited to this application. Use for latching of lids of all types, in particular for rear trunk compartments, is equally conceivable and is likewise to be encompassed by the invention.

Figure 3:
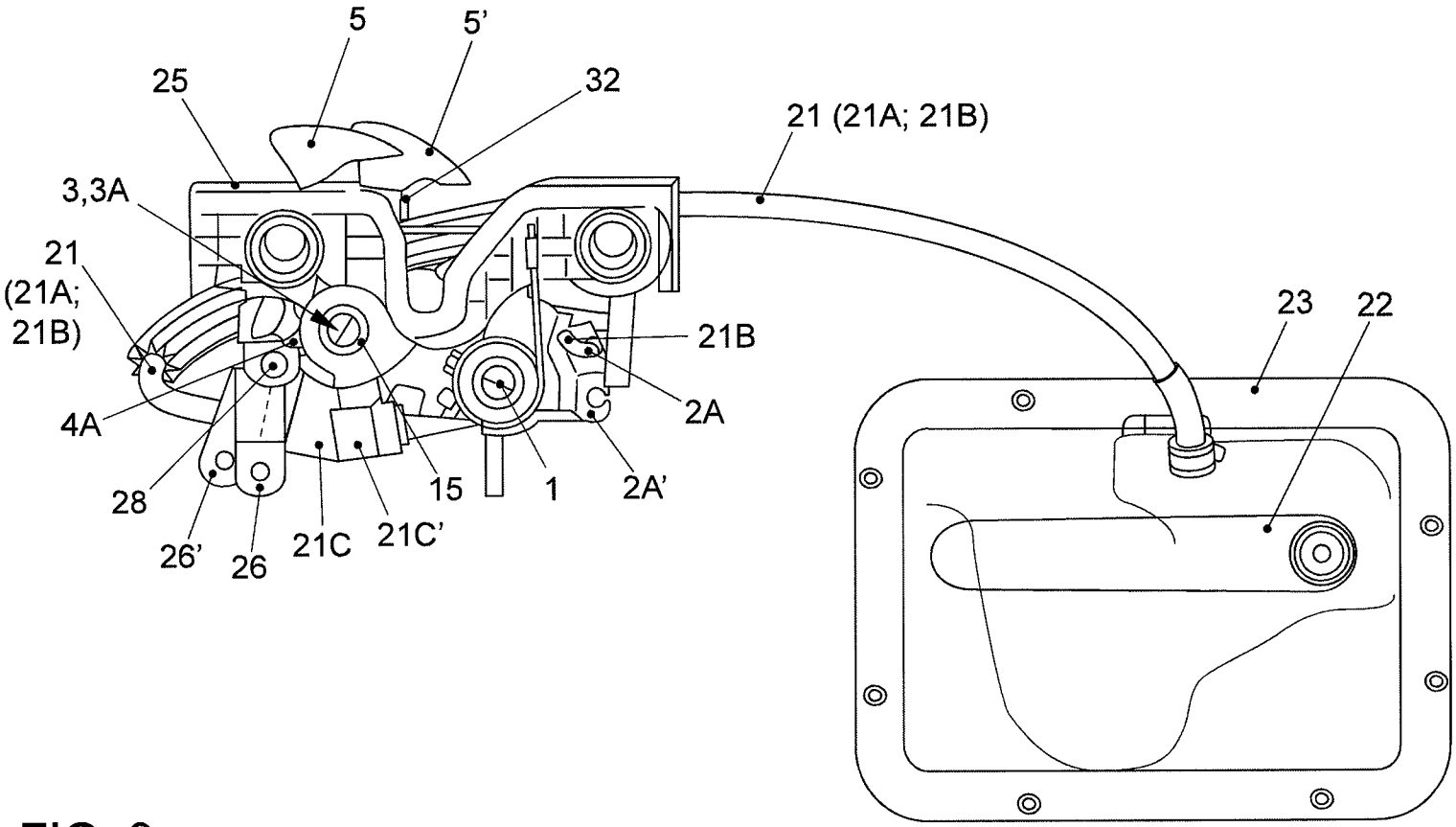
FIG. 3 shows a schematic representation of the closure system according to the invention, in a view of the trunk compartment from the outside looking in, with a remotely actuatable emergency release additionally being shown.

FIG. 2 shows a schematic representation of the closure system according to the invention, in particular a front lid system in a view from the inside of a trunk compartment looking out, while FIG. 3 shows a schematic representation of the closure system according to the invention in a view of the trunk compartment from the outside looking in, with a first remotely actuatable handle for emergency release being shown in addition.

Figure 4C:
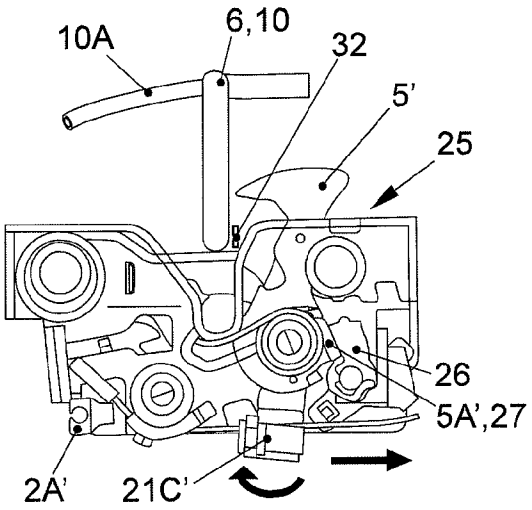
FIG. 4A, 4B, 4C show a schematic representation of the sequence of motion of the components during emergency release.
Figure 4B:
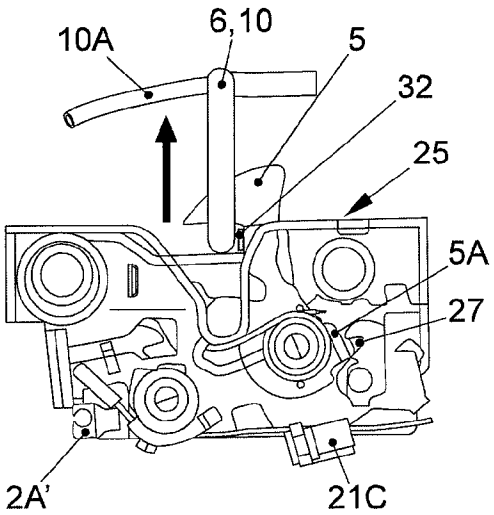
Figure 4A:
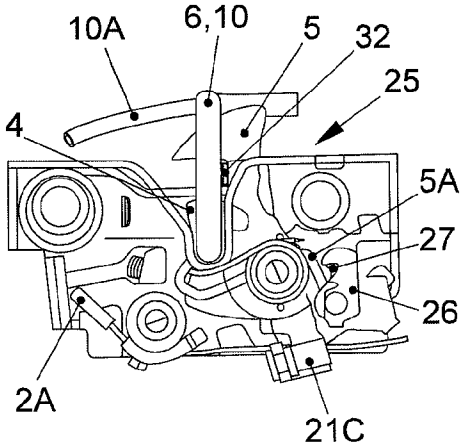

FIGS. 2 and 3, and also FIGS. 4A through 4C, are explained in conjunction with one another. FIG. 4A shows the closure system in a latched rest position, while FIGS. 4B, 4C illustrate the step-by-step release.

The new front lid system essentially includes, without change, a detent pawl 2 arranged such that it can pivot about a first axis of rotation 1, a rotary latch 4 arranged such that it can pivot about a second axis of rotation 3, a catch hook 5 that can pivot about a third axis of rotation 3A, and a striker 6, wherein the catch hook 5 is associated with the rotary latch 4.

The detent pawl 2 and the rotary latch 4 are mounted as before in a lock cover 20 attached to the body of a motor vehicle. The striker 6 is located on the front lid of the motor vehicle in such a manner that the rotary latch 4 stands in operative connection with the striker 6 when the front lid is in the closed position and is locked by the detent pawl 2. The striker 6 is still essentially U-shaped and has a center bar 10. The rotary latch 4 is still forked in design and has a recess 8 that is matched to the contour of the center bar 10. In the unchanged locked state, the recess 8 receives the center bar 8 of the striker 6. The rotary latch 4 also has a stop 7 that engages a formation 9 in the form of a tooth segment on the detent pawl 2 in the locked state. In this locked position, the rotary latch 4 securely receives the center bar 10 of the striker 6 in its recess 8. This state is not shown in FIGS. 2 and 3. The catch hook 5 is connected to a return spring 16, wherein the catch hook 5 has, at a free end 12, a hook part 13, which performs a securing function.

In the new, modified closure system, a stop 32 is now located on the front of the catch hook 5—a change from the prior art. The pivoting motion of the catch hook 5 is only permitted up to a certain angle in the direction (see arrow) of the force $F_R$ of the return spring 16, since the stop 32 limits the pivoting motion.

In the opposite direction, the catch hook 5 in its emergency release position 5' can pivot significantly further than before in the direction (see arrow) opposite the force $F_R$ of the return spring 16 in a lock-mounted guide 25—a change from the prior art. The significance of this will be explained in detail further below.

When latching of the front lid is deactivated, the hook part 13 receives the center bar 10 of the striker 6, as before. This position, which is established after the first step of emergency release according to the invention, is shown in FIG. 4B. The arrow in Figure [sic] shows the motion of the striker 6 in the position in which it remains captured in the catch hook 5.

The catch hook 5 is preloaded by the return spring 16, which changes its direction of action with respect to the prior art, up to the stop 32 in a locking position, so that when the locking is released the center bar 10 is initially prevented from opening fully in its opening travel upward by the hook part 13.

In a first step of emergency release, the locked state is released by manual actuation of a first Bowden cable 21 or a first electric motor drive, wherein the position reached by the front lid after the unlocking still does not permit opening of the front lid. This first Bowden cable 21 is additionally provided—a change from the prior art.

The second Bowden cable known from the prior art is not shown. It remains present, and performs the release function from inside the passenger compartment of the vehicle already known from the prior art.

The first Bowden cable 21 acts on the detent pawl 2 at a first wire receptacle 2A, wherein the first wire receptacle 2A and the detent pawl 2 assume the position 2', 2A' (see FIG. 2) when the first Bowden cable 21 is pulled. Depending on whether the first Bowden cable 21 or the second Bowden cable is actuated, the previously known release function of the trunk compartment can be triggered from inside the passenger compartment of the vehicle, for example, or the new emergency release function can be triggered from within the interior of the trunk compartment. In FIG. 2, the empty second wire receptacle is shown in the position 2B, 2B' with the second Bowden cable (which itself is not shown) pulled and not pulled.

In order to actuate the first Bowden cable 21, a body-mounted receptacle 23 that houses a first handle 22 in the manner of a pull handle is arranged in the trunk compartment. As a result of the triggering, the formation 9 of the detent pawl 2 is pulled away from the stop 7 of the rotary latch 4. To this end, a first wire receptacle 2A, in which is secured a wire end piece 21B-1 of the Bowden cable wire 21B of the first Bowden cable 21, is arranged on the detent pawl 2.

The actuation of the first Bowden cable 21 by pulling the Bowden cable wire 21B pivots the first wire receptacle 2A into the position 2A', causing the rotary latch 4, which is preloaded by a spring 15, to rotate about the second axis of rotation 3.

The ejector spring 14 acts on the striker 6 to be opened and presses it upward upon actuation of the first Bowden cable 21 or of the first electric motor drive.

As in the prior art closure system, the third axis of rotation 3A of the catch hook 5 is arranged to run on a common axis of rotation with the second axis of rotation 3 of the rotary latch 4, and the catch hook 5 can pivot about the third axis of rotation 3A associated therewith independently of the rotary latch 4.

The front lid could now be opened from the outside by lateral pivoting of the striker 6 using the striker handle 10A (see FIGS. 4A, 4B and in particular FIG. 4C). During the necessary actuation, the center bar 10 of the striker 6A assumes the position shown in FIGS. 1 and 2. However, this release from the outside cannot be carried out by a person trapped inside the trunk compartment.

As is shown especially well in FIG. 4C starting from FIGS. 4A, 4B, but is also shown in FIGS. 2 and 3, the catch hook 5 can be pivoted further into a position 5'—a change from the prior art. To this end, the above-described lock-mounted guide 25 in the housing of the lock is longer in design, so that the catch hook shown in FIGS. 2 and 4C can be pivoted further to the right than previously or, as shown in FIG. 3, can be pivoted further to the left than previously.

In a second step of the emergency release, a further actuation of the first Bowden cable 21 by further pulling (to the right, as shown by the arrow) of the first handle 22 ensures that the lock fully releases the striker 6.

To this end, a Bowden cable receptacle 21C is arranged at the end of the catch hook 5 opposite the hook part 13. The Bowden cable jacket 21A (not shown in FIG. 2) of the first Bowden cable 21 is secured in the Bowden cable receptacle 21C. In the course of the further actuation of the first Bowden cable 21 that immediately follows the actuation already performed, the Bowden cable wire 21B cannot be pulled further in the first wire receptacle 2A'. The first wire receptacle 2A' reaches an end stop in the position 2A'.

As a result, in compensation for the further pulling motion on the Bowden cable wire 21B performed by the first handle 22, the Bowden cable jacket 21A (not shown in detail) exerts a reaction force on the Bowden cable receptacle 21C, causing the Bowden cable receptacle 21C' to be pivoted into the position 21C' (to the left in FIGS. 2 and 4C, and to the right in FIG. 3), as is shown by the arrow beneath the Bowden cable receptacle 21C', which refers to the rotary motion of the catch hook 5 about the axis of rotation 3A.

As a result, the catch hook 5 pivots about the third axis of rotation 3A of the catch hook 5 in the direction opposite the Bowden cable receptacle 21C' into the position 5' (to the right in FIGS. 2 and 4C, and to the left in FIG. 3). In this position, the catch hook 5' releases the center bar 10 of the striker 6.

In order to prevent a return of the catch hook 5' to the position 5 when the first handle 22 is let go, since the catch hook 5' is always attempting to return to its initial position 5 due to the return spring 16, a detent projection 5A is arranged at the base of the catch hook 5—a departure from the prior art; before the second actuation step, this detent projection sits in the illustrated position 5A, and after the second actuation step it has been pivoted into the position 5A'. There, the detent projection 5A' engages in a contour 27 that corresponds to the outside shape of the detent projection 5A' and that is located at the end of a detent element 26'. At this moment, the detent element 26' pivots against the force of an additional return spring 29 into a detent position in the manner of a detent lever, tensioning the return spring 29.

The detent projection 5A' of the catch hook 5' is held in the contour 27 until a cam 4A, which is located in the region of the detent element 26' on the outer contour of the rotary latch 4, runs into the detent element 26' above its axis of rotation, by which means the contour 27 of the detent element releases the detent projection 5A' and the safety latching of the catch hook 5' in the contour 27 is deactivated. The cam 4A runs into the detent element 26' at the moment when the rotary latch 4' moves back into the locking position of the striker 6 during closing of the latch. The unlatching thus takes place automatically during closing of the front lid.

Figure 5:
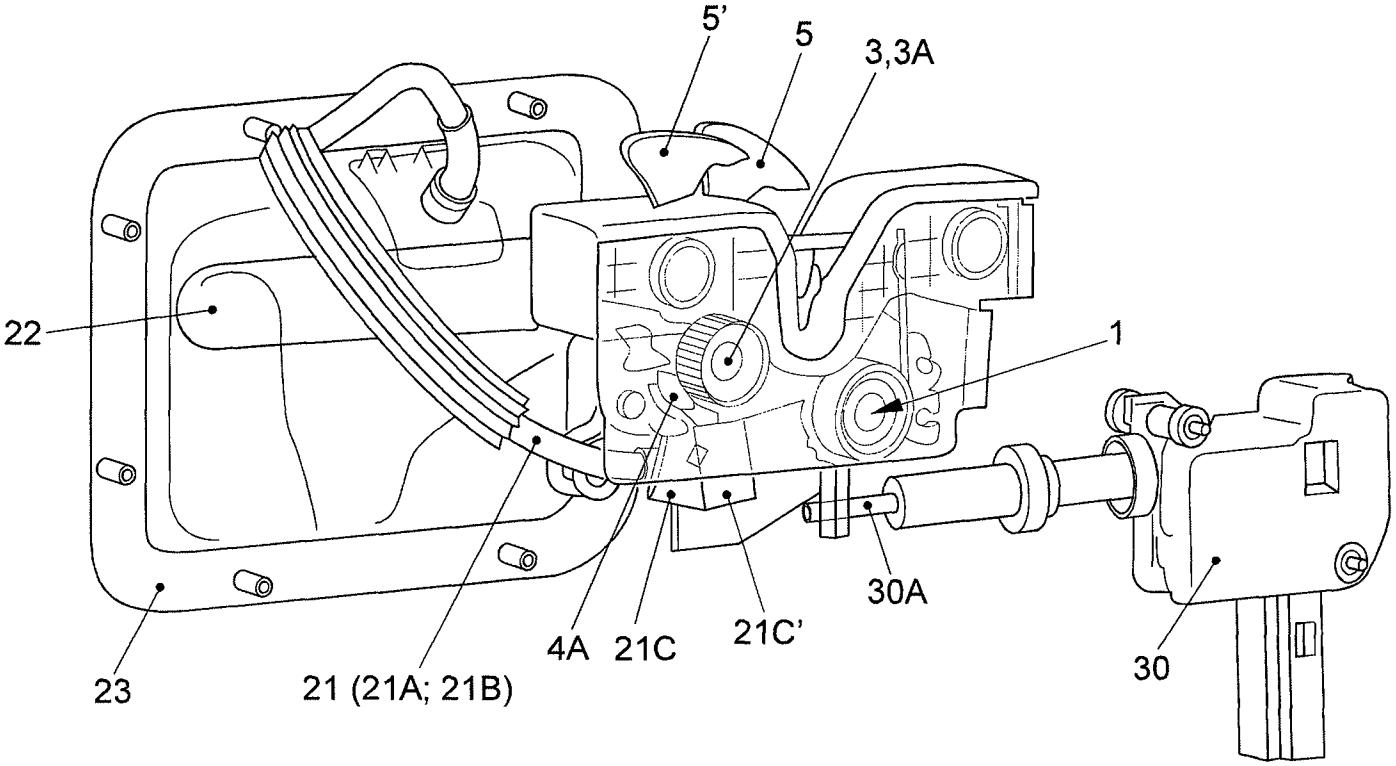

In order to ensure that complete opening of the emergency release by means of the first handle 22 is only permitted when the speed of the vehicle during forward travel is less than 5 km/h, an actuating unit 30, which receives actuating signals from a control unit (not shown) of the on-board electronics, is provided as shown in FIG. 5.

The actuating unit 30 has a coupling member 30A that is connected to the Bowden cable receptacle 21C. The above-described actuation of the Bowden cable receptacle 21C results in pivoting of the catch hook 5 into the emergency release position of the catch hook 5'.

In order to avoid this pivoting above 5 km/h, the coupling member 30A mechanically engages the Bowden cable receptacle 21C and locks the Bowden cable receptacle 21C until the actuating unit 30 receives a release signal below 5 km/h and deactivates the mechanical locking by the coupling member 30 A. Only then does actuation of the first handle 22 from inside the trunk compartment lead to the desired emergency release function. This ensures that complete release does not take place above a vehicle speed of 5 km/h.

The actuating unit 30 and the coupling member 30A can also be used for electronic central locking of the vehicle independently of the locking based on speed. On the one hand, a signal can be transmitted to the central locking system by means of the key, ensuring that complete release of the front lid is possible when the vehicle is stationary. In this case, the mechanical coupling member 30A does not lock the Bowden cable receptacle 21C. On the other hand, a signal can be transmitted that only allows opening of the rotary latch 4 through the detent pawl 2. In this case, the central locking system is used to ensure that the mechanical coupling member 30A locks the Bowden cable receptacle 21C.

For the sake of completeness, it is noted once again that when the second Bowden cable (not shown) is pulled from inside the passenger compartment of the vehicle and the vehicle speed is less than 5 km/h, the rotary latch 4 is indeed opened and releases the striker 6, but the hook part 13 of the catch hook 5 captures the striker 6 in the position 5 shown in FIG. 2. The front lid does not open completely, in a manner analogous to the prior art. The front lid can be opened from the outside by laterally pivoting the striker 6 out of the catch hook 5. During this actuation, in a manner analogous to the prior art the center bar 10 of the striker 6A assumes the position that is shown in FIG. 1 and explained in connection with FIG. 1.

LIST OF REFERENCE CHARACTERS

1 axis of rotation of the detent pawl
2 detent pawl
2' detent pawl
2A first wire receptacle
2A' first wire receptacle
2B second wire receptacle
2B' second wire receptacle
2B redirection
3 axis of rotation of the rotary latch
3A axis of rotation of the catch hook
4 rotary latch
4' rotary latch
4A cam
5 catch hook
5A detent projection
5A' detent projection
6 striker, vertical
6A striker, pivoted
7 stop/latching region of rotary latch
8 recess for striker
9 formation/latching region of detent pawl
10 center bar
10A striker handle
11 hook underside
12 free end
13 hook
14 spring element/ejector spring
15 rotary latch return spring
16 catch hook return spring
17 outer contour of the hook
18 end of the hook
19 outer contour of the center bar
20 lock cover
21 first Bowden cable
21A Bowden cable jacket
21B Bowden cable wire
21B-1 wire end piece
21C Bowden cable receptacle
21C' Bowden cable receptacle
22 first handle
23 body-mounted receptacle
24 stop
25 guide
26 detent element
26' detent element (position during emergency release)
27 contour
28 fourth axis of rotation
29 return spring of the detent element
30 actuating unit
30A coupling member
32 stop
' position in an emergency release
$F_R$ force of the return spring 16

The invention claimed is:

1. A closure system for emergency release of a front lid of a trunk compartment of a vehicle, the closure system comprising:

in a lock, a rotary latch arranged such that it can pivot about a second axis of rotation, the latch being held securely in a closed position of the front lid by a detent pawl arranged such that it can pivot about a first axis of rotation, and a catch hook associated with the rotary latch;

a stop located in front of the catch hook to limit forward motion of the catch hook; and a striker operatively connected with the rotary latch in the closed position, in that the rotary latch locks the striker with respect to a lock housing, wherein the lid is temporarily captured and held in an intermediate position by the catch hook, through the striker, after deactivation of the locking of the rotary latch, wherein the unlocking of the rotary latch and the release of the catch hook that has been captured in the intermediate position for complete release of the front lid in an emergency is accomplished via a first handle standing in operative connection with the rotary latch and the catch hook by a first remote actuating mechanism, said handle being located in a cavity that is enclosed by the front lid.

2. The closure system according to claim 1, wherein the first remote actuating mechanism is a first Bowden cable.

3. The closure system according to claim 2, wherein a Bowden cable wire of the first Bowden cable is secured in a first wire receptacle of the detent pawl, by which means the detent pawl, in a first step due to pulling on the first handle, pivots about the second axis of rotation and releases the rotary latch, which assumes a position that releases the striker, wherein the striker is captured in the intermediate position by the catch hook.

4. The closure system according to claim 2, wherein a Bowden cable jacket of the first Bowden cable is supported in a first Bowden cable receptacle, by which means pulling on the first handle in a second step causes the catch hook to pivot about a third axis of rotation and release the catch hook, which moves from the intermediate position to assume a position that completely releases the striker.

5. The closure system according to claim 2, wherein the catch hook has, on an end opposite the hook part, a detent projection that engages a contour of a detent element corresponding to the detent projection when the catch hook is in the position that releases the striker, wherein the pivoting of the catch hook into the position that releases the striker causes the detent element to be pivoted about a fourth axis of rotation into a position that temporarily latches the catch hook securely.

6. The closure system according to claim 5, wherein a cam is located on the outer contour of the rotary latch near the region of the detent element that is latched into the contour by means of the detent projection, which cam runs into the detent element having the contour above the fourth axis of rotation when the detent element is in the latched position, by which means the contour is pushed away and the detent projection exits the detent and is released in order to deactivate the safety latching of the catch hook.

7. The closure system according to claim 5, wherein the stop limits the pivoting motion of the catch hook opposite the direction of a force of a return spring of the catch hook.

8. The closure system according to claim 2, wherein the first remote actuating mechanism and the associated handle for emergency release of the lid of the closure system are located in a forward trunk compartment of the vehicle, wherein the second remote actuating mechanism for releasing the lid of the closure system in the intermediate position is located in the trunk and the associated second handle is located in the passenger compartment of the vehicle.

9. The closure system according to claim 2, further comprising a first wire receptacle on the detent pawl.

10. The closure system according to claim 9, wherein the Bowden cable acts on the detent pawl at the first wire receptacle.

11. The closure system according to claim 9, wherein a wire end piece of the first Bowden cable is secured within the first wire receptacle.

12. The closure system according to claim 2, wherein the first Bowden cable is secured to the catch hook.

13. The closure system according to claim 1, wherein the closure system has a second remote actuating mechanism in the manner of a second Bowden cable, which accomplishes, independently of the first remote actuating mechanism, a partial release of the lid that captures and holds the lid in the intermediate position.

14. The closure system according to claim 1, wherein the actuation of the catch hook is to be suppressed during emergency release of the lid of the closure system or during release of the lid of the closure system in the intermediate position, by means of an arranged first blocking mechanism and a second blocking mechanism, which is to be switched as a function of a predefinable driving speed of the vehicle and/or a central locking system.

15. The closure system according to claim 14, wherein the first blocking mechanism, which blocks or releases the catch hook during emergency release of the lid as a function of a predefinable driving speed, is a mechanical coupling member of an actuating unit that acts to block or release the Bowden cable receptacle of the catch hook.

16. The closure system according to claim 1, further comprising a detent projection arranged at a base of the catch hook.

17. The closure system according to claim 1, further comprising a return spring providing forward force to the catch hook in a direction opposite that needed to release the striker from the intermediate position.

18. A closure system for release of a lid of compartment of a vehicle, the closure system comprising:

a lock, said lock comprising:

a detent pawl pivotable about a first axis of rotation;

a rotary latch pivotable about a second axis of rotation, the rotary latch being held, in a closed position of the lid, by the detent pawl; and a catch hook connected to the rotary latch;

a stop located in front of the catch hook to limit forward motion of the catch hook;

a striker operatively connected to the rotary latch in the closed position such that the rotary latch locks the striker;

a first handle located in the trunk compartment and operatively connected to the rotary latch; and a first remote actuating mechanism, wherein the lid is temporarily held in an intermediate position by the catch hook, through the striker, after deactivation of the locking of the rotary latch, and wherein unlocking of the rotary latch and release of the catch hook in the intermediate position for complete release of the lid is accomplished by actuating the handle through the first remote actuating mechanism.

19. The closure system according to claim 18, further comprising an electromagnetic mechanism that arrests actuation of the detent pawl by the first actuating mechanism when the speed of the vehicle is above a predetermined speed.

* * * * *